US006169498B1

(12) United States Patent
King et al.

(10) Patent No.: US 6,169,498 B1
(45) Date of Patent: Jan. 2, 2001

(54) DEVICE AND METHOD FOR COMMUNICATION LOCATION-SPECIFIC MESSAGES

(75) Inventors: Neal J. King, Oakland; William J. Beyda, Cupertino, both of CA (US)

(73) Assignee: Siemens Information and Communication Networks, Inc., Boca Raton, FL (US)

( * ) Notice: Under 35 U.S.C. 154(b), the term of this patent shall be extended for 0 days.

(21) Appl. No.: 08/896,047

(22) Filed: Jul. 16, 1997

(51) Int. Cl.[7] ..... G08G 1/123

(52) U.S. Cl. ..... 340/999; 340/539; 340/825.36; 340/825.49; 455/18; 455/66; 369/31; 369/70

(58) Field of Search ..... 340/999, 539, 340/691.6, 692, 825.36, 825.49, 10.41; 455/151.2, 18, 66, 186.2, 186.1, 517; 369/20, 30, 31, 69, 70

(56) References Cited

U.S. PATENT DOCUMENTS

| | | | | |
|---|---|---|---|---|
| 5,020,155 | | 5/1991 | Griffin et al. | 455/617 |
| 5,152,003 | | 9/1992 | Poch | 455/18 |
| 5,532,680 | | 7/1996 | Ousborne | 340/567 |
| 5,555,446 | | 9/1996 | Jasinski | 455/54.2 |
| 5,649,300 | * | 7/1997 | Snyder et al. | 455/17 |
| 5,687,103 | * | 11/1997 | Hagl et al. | 364/514 |
| 5,732,326 | * | 3/1998 | Maruyama et al. | 455/66 |
| 5,848,129 | * | 12/1998 | Baker | 379/67.1 |
| 5,887,275 | * | 3/1999 | Nguyen et al. | 711/206 |

* cited by examiner

*Primary Examiner*—Daryl Pope

(57) ABSTRACT

A method for communicating location-specific messages includes storing a library of such messages within a portable device having a capability of randoly accessing the messages. Each location-specific message has a content that is related to a particular geographical location within a facility. At each of the geographical locations, there is a device-readable identification of an identifier for each location-specific message relating to that geographical location. In the preferred embodiment, the identifier is transmitted to the portable device wirelessly. Also in the preferred embodiment, the message library is contained on a recording medium that facilitates automated random access, such as a compact disk, and the portable device is a personal digital assistant (PDA). In an application of the method, map information may be prerecorded and supplemented or complemented with time-dependent information downloaded from a source. The fixed map information and the time-dependent information may then be accessed to locate a particular site specified by the time-dependent information. For example, the map information may include gate locations within an airport and the time-dependent information may include flight arrival and departure times.

16 Claims, 4 Drawing Sheets

DEVICE AND METHOD FOR COMMUNICATION LOCATION-SPECIFIC MESSAGES

BACKGROUND OF THE INVENTION

The invention relates generally to methods and devices for communicating messages, and more particularly to methods and devices for presenting messages that are specific to locations within a particular facility.

DESCRIPTION OF THE RELATED ART

There are numerous occasions for which access to geographically based messages relating to a particular facility is important to a visitor of the facility. Within an airport, there are both fixed information, such as the directions to gates, and time-dependent information, such as the arrival and departure times of flights. The fixed information is presented as location-specific messages on overhead signs, while the time-dependent information is often presented on a monitor. Access to geographically based information is also important to visitors of museums, conference halls, and other facilities having an arrangement of different exhibits and displays.

One known method of presenting location-specific messages is to attach a plaque at each display. For example, each site within a museum may include a plaque that provides background information relevant to the display at the site. A concern with this method is that space considerations place limits on the depth of the commentary at each display.

Another known method is to broadcast an announcement of the location-specific message at each display. The announcement may be provided by an employee of the facility or may be a prerecorded announcement that is periodically repeated. A simultaneous announcement to a group of visitors operates well if the visitors arrive simultaneously, but a late-arriving visitor must wait for the message to restart in order to hear the beginning of the message.

As noted in U.S. Pat. No. 5,152,003 to Poch, each visitor may be equipped with a portable tape recording apparatus, such as a cassette player, that includes prerecorded narratives. The visitor is instructed to follow a set path that permits the location-specific messages to be played sequentially. An advantage of this method is that the user can start and stop the apparatus as desired. Another advantage is that facilities having visitors from various countries may dispense cassette tapes in accordance with the native language of the visitor. A disadvantage is that the recordings require that the visitor follow a predetermined order of displays. That is, the method is not responsive to the desires of the visitor, unless the visitor is willing to hunt for the location-specific messages when the prescribed order of displays is not followed.

The solution proposed in Poch is to provide each visitor with a receiver having a number of receiving channels. Each channel is associated with a different frequency. When a visitor of a museum or other tourist attraction is equipped with the receiver, messages relating to exhibits may be received in the sequence determined by the visitor. The messages are transmitted on different frequencies of the FM commercial broadcast band (88.1–107.9 MHz). When a receiver is tuned to a particular frequency (e.g., by pressing a particular key on a keyboard that is part of the receiver), the receiver announces a message. Low-power message transmitters are utilized, so that frequencies may be reused in different locations of the museum or tourist attraction. While this method provides message presentation without regard for the sequence of the demand of the user, i.e. the user may visit displays in any order, the method is subject to the disadvantages of message looping. The messages are regionally transmitted, so that latearriving users must wait until the message loop returns to the beginning in order to fully appreciate the message. That is, the user cannot change the timing of the message presentation. Moreover, there are limitations as to how many different channels can be used within the broadcast band. This limitation is more problematic if the message specific to a display is broadcast in a number of different languages, with each language being assigned a different channel.

A similar approach is described in U.S. Pat. No. 5,020,155 to Griffin et al. Each display or exhibit in an art gallery, museum, zoo, or fair is associated with a fixed unit that is designed to provide a commentary in response to a request transmitted by a portable unit. Each visitor of the facility has a portable unit that includes an emitter that transmits the request for the start of a particular commentary. In response to the request, the fixed unit at a particular display transmits the selected commentary via a set FM channel. A single display may be associated with a number of messages, so that a user may select a particular language or may select among depths of commentary. An advantage of the Griffin et al. method is that it permits time-shifted transmissions of the same commentary, since the commentary is transmitted to different visitors on separate channels. The start time of a transmission is determined by the request received from the portable unit of the visitor. However, there are a limited number of available channels. The patent notes that if a visitor requests a commentary when all of the channels of a particular display are in use, the portable unit of the visitor may be programmed to provide an audible "busy" signal.

What is needed is a method and apparatus for communicating location-specific messages within a facility in a manner that enables each visitor to freely determine the timing of message presentation.

SUMMARY OF THE INVENTION

A method and portable device for communicating location-specific messages include storing a library of such messages within the portable device having the capability of providing automated random access to the messages within the library. Each location-specific message has a content that is related to a particular geographical location within a facility. Moreover, each location-specific message has a correspondence with an identifier. At each of the geographical locations within the facility, there is a device-readable identification of the identifier that corresponds to the location-specific message having a content related to the geographical location. In one embodiment, the device-readable identification is implemented by transmitting a signal that is indicative of the identifier. The wireless transmission is received at the portable device and the indicated identifier is displayed at the device in response to the wireless reception. In another embodiment, the device-readable identification is implemented by attaching a barcode at each of the geographical locations, with each barcode uniquely identifying only location-specific messages having content related to the geographical location at which the barcode is attached.

In one embodiment, the invention is utilized to provide audible commentaries relating to exhibits, displays, or artwork within a facility such as a museum. There is a one-to-one relationship between identifiers and the messages of the message library, but there may be more than one message having content relating to a specific exhibit, display, or artwork. Thus, a visitor may select among messages distinguished by depth of audible commentary or by language. If there is more than one message specific to a location, all of the identifiers for the messages are presented.

In the preferred embodiment, the message library is contained on a recording medium that facilitates automated random access, such as a compact disk. The portable device may be a personal digital assistant (PDA) owned by the user. However, the portable device may be distributed by the operators of the facility.

In another embodiment, the portable device is used to store map information relating to various sites within a facility. The map information is fixed data that is supplemented or complemented with time-dependent information downloaded from a source to the portable device. The fixed map information and the time-dependent information may then be accessed to locate a particular site specified by the time-dependent information. For example, the invention may be used within an airport, with the map information including gate locations and with the time-dependent information including flight arrival and departure times. The step of downloading the time-dependent information may be executed using wireless transmission from the source to the portable device, but other implementations may be utilized. In the application of the method and device within an airport, a flight arrival time and gate number may be accessed from the time-dependent information, while the gate location may be determined by accessing the map information. Optionally, the map information may be further supplemented by navigation information that is received wirelessly and that is dynamically accessed in the same manner as accessing a Global Positioning System (GPS).

The portable device for communicating the location-specific messages includes the memory for storing the message library. As previously noted, this memory may be in a CD format. Each location-specific message may be associated with a unique identifier, and each has content relating to a particular geographical location. The device includes an input for reading a signal indicative of the identifier. In response to receiving the identifier, the memory is randomly accessed in order to announce the location-specific message unique to the identifier.

DETAILED DESCRIPTION

Figure 1:
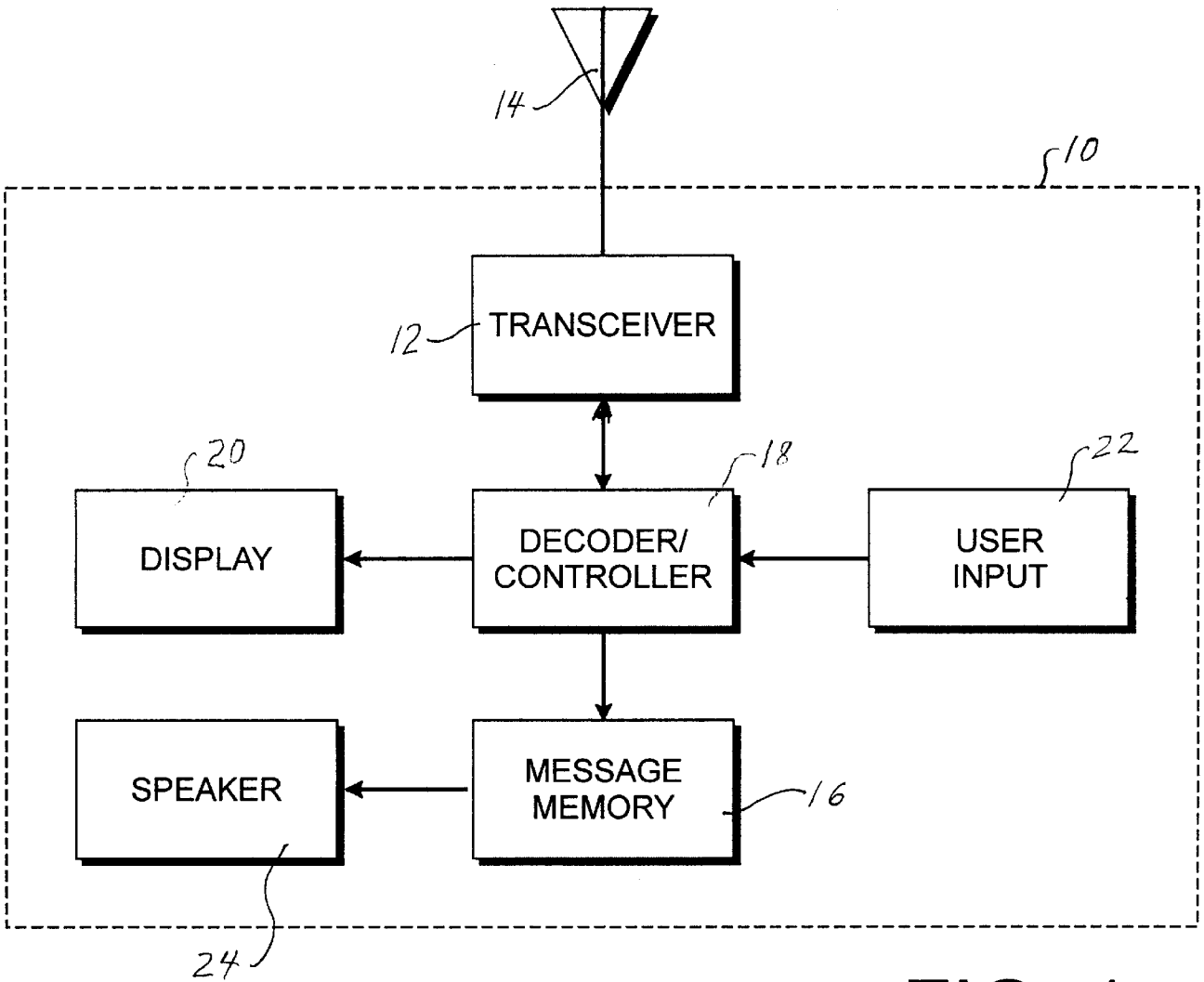
FIG. 1 is a block diagram of a portable device for communicating location-specific messages in accordance with the invention.

FIG. 1 illustrates a portable device 10 for use in facilities in which selective communication of location-specific messages is advantageous. Such facilities include museums, art galleries, and other operations that have a number of displays and exhibits. In another embodiment, the portable device 10 is used to cooperatively associate fixed map information with time-dependent information.

The portable device 10 may be a personal digital assistant (PDA) having the capability of receiving wireless transmissions. PDAs having wireless capability for receiving e-mail and the like are known. In FIG. 1, the portable device 10 includes a transceiver 12 connected to an antenna 14. As will be explained more fully below, the transceiver 12 is utilized to detect signals indicative of codes for uniquely identifying location-specific messages within a message memory 16. In some embodiments, the transceiver is also used to send signals that are related to geographically based information.

The components of the portable device 10 are controlled by a decoder/controller 18. The decoder/controller includes a microprocessor. In one embodiment, the codes that are received via the antenna 14 and transceiver 12 are presented to a user by means of a display. The display may be a liquid crystal display (LCD), but this is not critical. A displayed code is an identifier of a particular location-specific message stored in the memory 16. Optionally, each site in a facility may generate more than one coded identifier. The use of multiple identifiers is beneficial to circumstances in which there are multiple stored location-specific messages having content relating to a single site. For example, there may be a selection of three levels of depth of commentary regarding a particular museum exhibit. The three identifiers may be presented to a user by means of the display 20, allowing the user to select the depth of commentary. As another example, the alternative location-specific messages relating to a particular site may have the same content, but in different languages. Again, the portable device 10 enables the user to select the appropriate message. In an application in which there is a one-to-one correspondence between the stored location-specific messages and the sites of a particular facility, the importance of the display 20 is significantly reduced.

After the coded identifier or identifiers have been presented to the user, the activation of the appropriate location-specific message may be triggered by means of a user input device 22. In the preferred embodiment, the user input device is a keyboard. If there are multiple identifiers for a particular site, a person selects among the identifiers by depressing keys in a particular sequence shown at the display. For example, the identifier "200" may be displayed as the appropriate input to trigger playing an English version of a detailed commentary of a particular museum exhibit, while the identifier "205" may be displayed as a trigger for initiating a Spanish version of the same message. A speaker 24 is used to announce the selected message. Within enclosed facilities, the speaker is preferably within headphones or an earpiece.

If there is a one-to-one correspondence between location-specific messages and sites within a facility, the user input device 22 may be a start switch and the display may be omitted. In this embodiment, the reception of the identifier upon entering a site automatically queues the appropriate location-specific message stored at memory 16. Announcement of the queued message is then triggered using the start switch.

Figure 2:
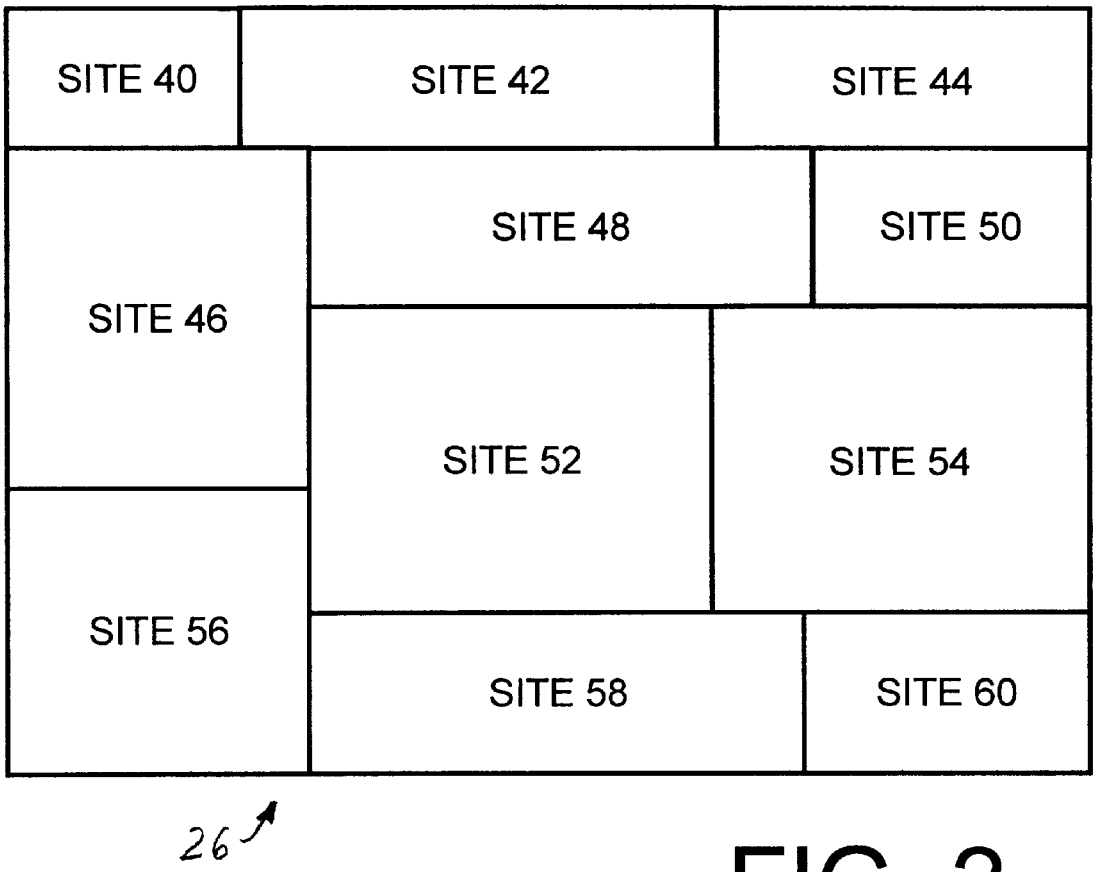
FIG. 2 is a schematical representation of a facility within which the device of FIG. 1 may be utilized.
Figure 3:
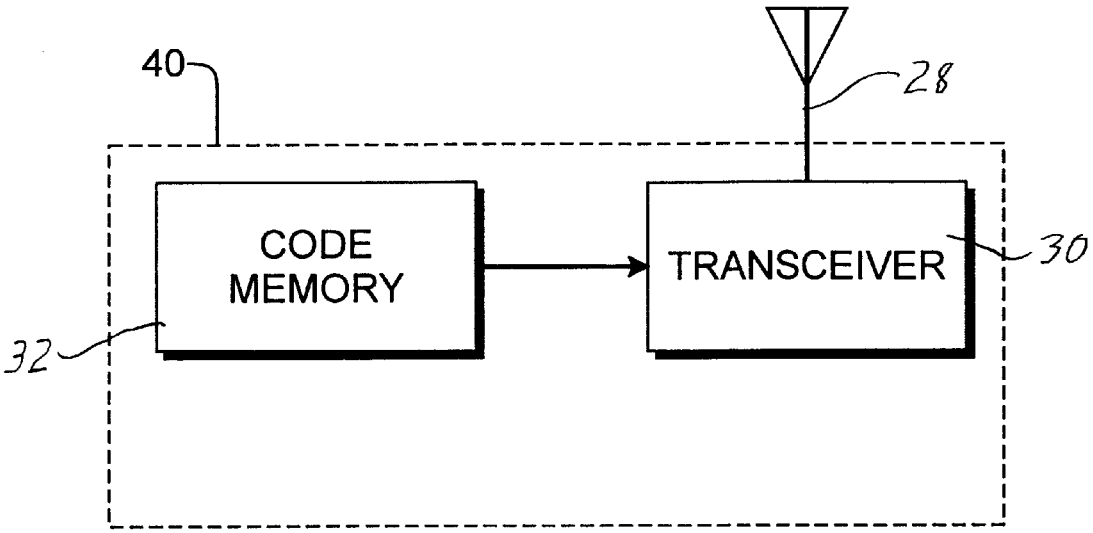
FIG. 3 is a block diagram of components within one of the sites of FIG. 2 for communicating with the portable device of FIG. 1.

Referring now to FIG. 2, a facility 26 is shown as being divided into a number of sites. The facility may be a museum in which each site is a different room having an exhibit. Within each site, a radio beacon is transmitted to provide a unique identification. FIG. 3 illustrates the components of Site 40 as including an antenna 28, a transceiver 30, and code memory 32. A similar arrangement is found in each of the sites of the facility 26. When the portable device 10 is brought within the range of the location's beacon, the relevant code or codes are presented on the display 20 of the portable device. The user then is able to select and initiate the appropriate location-specific message stored in the memory 16 of the portable device. As previously noted, the portable device is capable of randomly accessing the messages. Random access of segments of information is well known in the art of storing data in a CD format. While not shown in FIG. 1, the location-specific messages may include visual data that is displayed on the display 20 of the device. In applications in which there is a one-to-one correspondence between sites of the facility 26 and location-specific messages stored in the memory 16 of the device 10, the function of the code memory 32 may be achieved by assigning each of the sites of the facility with a different frequency for the radio beacon. The decoder/controller 18 of FIG. 1 could then determine the appropriate message identifier by detecting the frequency that is received via the antenna 14.

As an alternative to assigning a different frequency to each of the sites 40–60 of the facility 26, the sites may be associated with different numeric codes. This allows the portable device to remain tuned to a single frequency while the user travels among the sites. If there is a one-to-one correspondence between sites and numeric codes to be broadcast, the decoder/controller 18 of FIG. 1 may be set to automatically queue or to automatically play the appropriate location-specific message when the device is within the limited range of one of the broadcasts. On the other hand, if each site is associated with more than one numeric code (e.g., numeric codes for messages in different languages or different depths of detail), the decoder/controller may be used to determine and display the appropriate message identifiers on the display 20 of the device, so that the user can select among the messages.

In another embodiment, each site within the facility 26 is assigned a different barcode that is attached somewhere within the site. In this embodiment, the components of FIG. 3 are not required, and the antenna 14 and the transceiver 12 of FIG. 1 are replaced with a barcode reader. A user is then able to determine the appropriate location-specific message or messages based upon a reading of the barcode attached at the site in which the user is located.

For applications in which each site is associated with more than one location-specific message, the operation of the portable device 10 optionally includes a selection of a subset of the messages. As an example, at the start of a tour, a user may select Spanish-speaking messages, so that only the numeric codes or frequencies corresponding to the appropriate Spanish-speaking messages are detected by the portable device of the user. If the message identifiers are communicated wirelessly, the portable device may include filters that determine which numeric codes or frequencies are detected. The means for selectively detecting the messages is not critical to the invention.

Preferably, the portable device also has the capability of prematurely terminating a message presentation. If a user is not interested in hearing the remainder of the message, the user may start a different message prior to the time-out of the first. This may be implemented manually (e.g., a "kill button" on the device) or automatically (e.g., by detection that the portable device is no longer in the vicinity of the site associated with the message).

Figure 4:
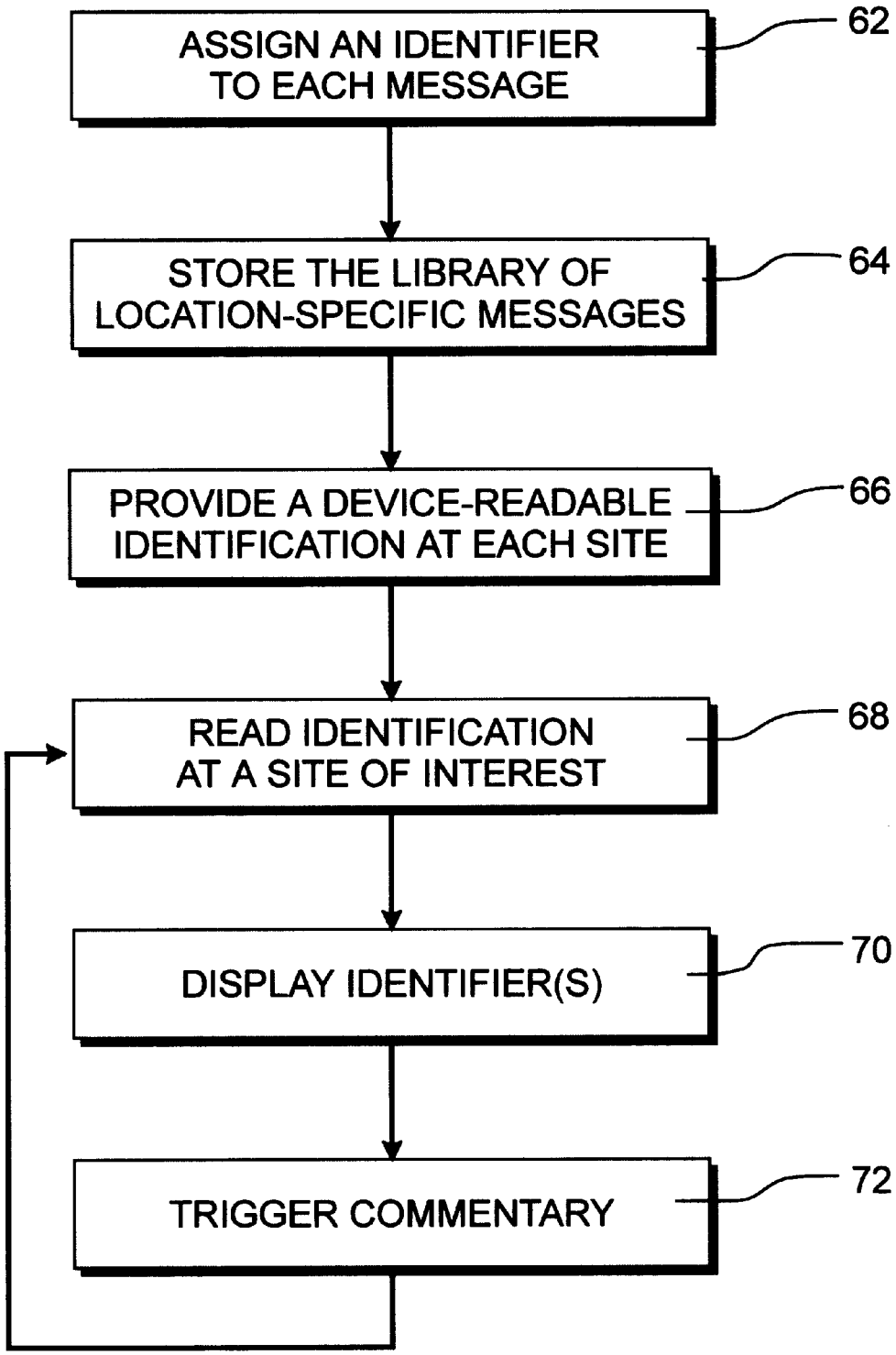
FIG. 4 is a process flow for implementing one embodiment of communicating location-specific messages in accordance with the invention.

Referring now to FIG. 4, in the operation of the invention described above, a preliminary step is to assign an identifier to each location-specific message, as indicated in step 62. In the preferred wireless embodiment, the identifiers may be frequency-based or signal content-based. Preferably, there is a one-to-one correspondence between identifiers and location-specific messages, so that each identifier is unique to a message.

In step 64, the library of location-specific messages is stored. Important to the invention is that the storage is in a format and device that accommodate random access of the memories. For example, the messages may be recorded on a CD ROM that is distributed to a person having a PDA with the proper drive.

If the library of location-specific messages is stored in a CD format, the distribution of a particular CD ROM or a particular portable device to a user may be based upon the native language of the user or the depth of commentary desired by the user. In an alternative embodiment to step 64, the library of messages is stored at a hard drive of the portable device or in random access memory (RAM) within the device.

At each of the sites of FIG. 2, a device-readable identification is provided, as noted in step 66. Preferably, the device-readable identification is a wireless transmission. However, the device-readable identification may be a barcode or other fixed readable attachment at a site of the facility 26.

When a user enters one of the sites 40–60 of the facility 26 of FIG. 2, the portable device detects the identification. This is shown at step 68 in FIG. 4. In response, the identifier or identifiers of messages having content relating to the site are displayed, as shown at step 70. If there is a single identifier, the display is not significant. However, applications in which there are multiple identifiers for a particular site include the display step in order to allow the user to easily select among the relevant commentaries. The differences in commentaries may be related to the language, the depth of detail, or both.

In the final step 72, the user triggers the initiation of the commentary. In FIG. 1, the user input device 22, e.g. a keyboard or start switch, is used to trigger the presentation of the appropriate location-specific message stored in the memory 16. A solely audio message is directed to the speaker 24, while a message that also includes a readout or other visual information is directed to the display 20 as well. Returning to FIG. 4, after the commentary has been completed, the process returns to step 68 to enable the portable device to read a second identification at a second site of a facility.

While the invention has been described primarily with respect to commentaries, this is not critical. The location-specific messages may be map information. For example, the portable device 10 may be an emergency-response unit.

Figure 5:
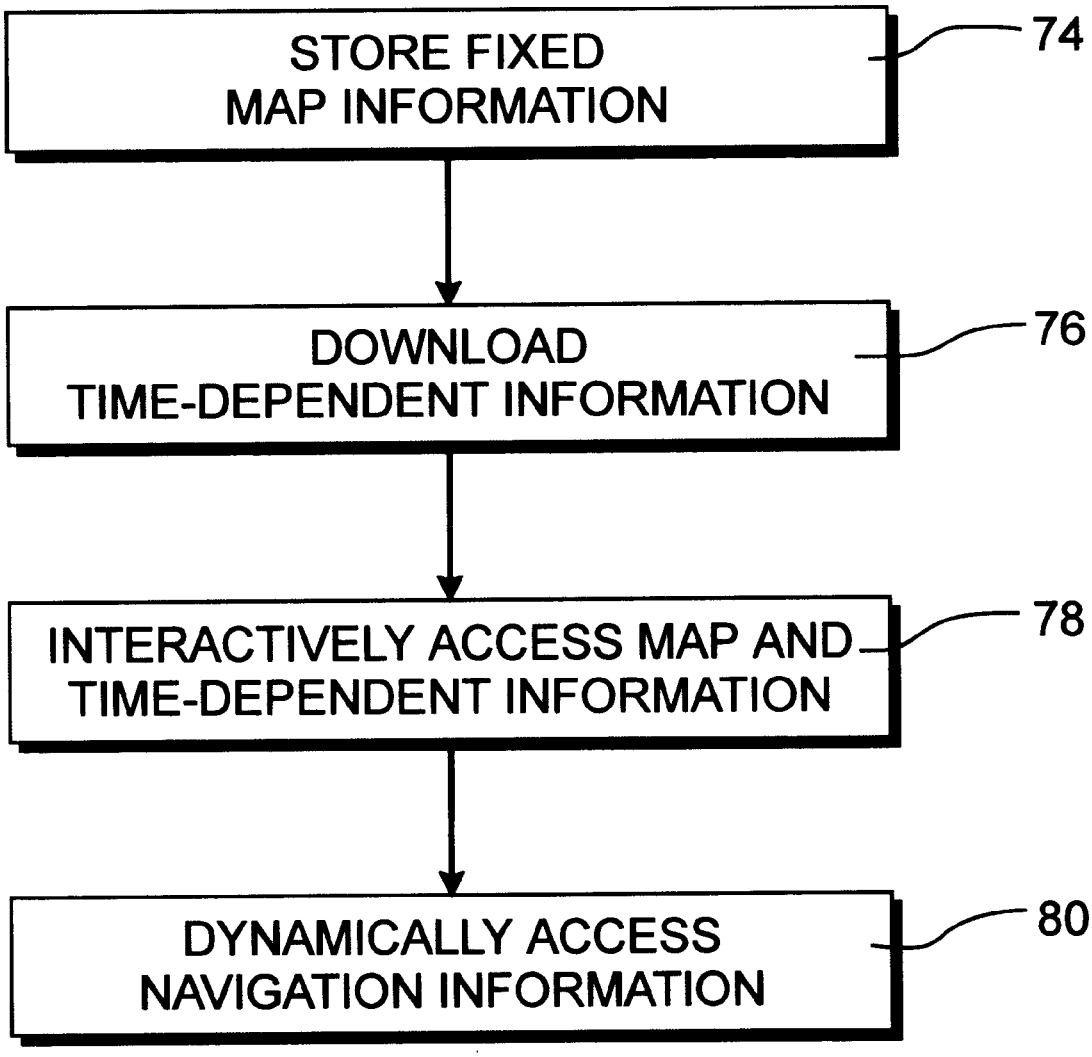
FIG. 5 is a process flow for a second embodiment of communicating location-specific messages in accordance with the invention.

In addition to commentaries and fixed map information, the invention may be used to provide a cooperative association between fixed location-specific information and time-dependent location-specific information. For example, the fixed information may be map information of a particular airport, while the time-dependent information may be flight arrival and departure times. Referring now to FIG. 5, in this embodiment the map information is stored at step 74. Because the map information is fixed, the information may be prerecorded in a read-only format. The map information is then supplemented by the time-dependent information that is downloaded to the portable device at step 76. In the preferred embodiment, the downloading is executed wirelessly, but physical connections to the source of the time-dependent information are also contemplated.

At step 78, the map and time-dependent information are interactively accessed. For example, if the downloaded time-dependent information is flight information regarding expected arrival and departure times and gate numbers, a user may select a particular flight, with the portable device responding to the selection by displaying the location of the gate. Thus, the prerecorded map information may be used to aid a user in navigating to the correct gate, based on the input of a flight number.

Optionally, the portable device is also able to access navigation information, as shown at step 80. For the airport application, there may be navigation beacons that enable the portable device to provide a continuous display of the location of the device within the airport. That is, if the portable device includes a graphical display, the map information and the navigation information may be used to visually indicate both the location of the device and any modifications in the orientation of the device. In some applications, the location may be determined by means of the GPS. While not shown in FIG. 5, the portable device may also be enabled to transmit signals in order to initiate actions, such as hailing a shuttle bus when the user has entered a baggage claim area of an airport.

What is claimed is:

1. A method of communicating location-specific messages comprising steps of:

storing a library of location-specific messages within a portable device having capability of providing automated random access to said location-specific messages, each location-specific message having a content related to a particular geographical location of a plurality of geographical locations;

establishing a correspondence between each location-specific message and an identifier of said each location-specific message, said correspondence being related to implementing random access; and at each of said geographical locations, providing a device-readable identification of at least one identifier that corresponds to a location-specific message having content related to said each geographical location, whereby said step of providing a device-readable identification includes wirelessly transmitting a signal indicative of said at least one identifier.

2. The method of claim 1 further comprising steps of wirelessly receiving said signal at said portable device and displaying said at least one identifier in response to said wireless reception.

3. The method of claim 1 wherein said step of storing said library of location-specific messages includes storing audible commentaries of said geographical locations.

4. The method of claim 3 wherein said library includes multiple location-specific messages for at least some of said geographical locations, said multiple location-specific messages being distinguishable with respect to depths of said audible commentaries.

5. The method of claim 1 wherein said step of storing said library includes recording said location-specific messages on a compact disk.

6. The method of claim 1 further comprising a step of storing map information in addition to said location-specific messages, said map information being indicative of orientations of said geographical locations.

7. The method of claim 1 wherein said step of establishing said correspondence includes forming a one-to-one relationship between said identifiers and said location-specific messages, said identifiers being codes.

8. A method of communicating location-specific messages comprising steps of:

storing a library of location-specific messages within a portable device having capability of providing automated random access to said location-specific messages, each location-specific message having a content related to a particular geographical location of a plurality of geographical locations; establishing a correspondence between each location-specific message and an identifier of said each location-specific message, said correspondence being related to implementing random access; and at each of said geographical locations, providing a device-readable identification of at least one identifier that corresponds to a location-specific message having content related to said each geographical location, wherein said step of providing a device-readable identification includes attaching a barcode at each of said geographical locations, each barcode uniquely identifying only location-specific messages having content related to the geographical location within which said each barcode is attached.

9. A method of communicating location-specific messages comprising steps of:

storing map information relating to a plurality of sites of a facility, said map information being stored in a portable device;

downloading time-dependent information specific of said facility, said downloading being from a source to said portable device; and accessing each of said map information and said time-dependent information to locate a particular one of said sites specified in said time-dependent information, wherein said step of downloading said time-dependent information includes wirelessly receiving a plurality of time-dependent messages, each time-dependent message specifying at least one of said sites.

10. The method of claim 9 wherein said step of storing map information is a step of storing data indicative of terminals of an airport, said time-dependent information being data indicative of airline flights.

11. The method of claim 9 further comprising a step of dynamically accessing navigation information as a complement to said stored map information, said dynamic access being dependent upon movement of said portable device.

12. The method of claim 11 wherein said step of dynamically accessing said navigation information includes wirelessly receiving said navigation information.

13. A portable device for communicating location-specific messages comprising:

memory having a stored library of location-specific messages, each location-specific message having a unique identifier and each having a content related to a particular geographical location of a plurality of geographi-cal locations;

input means for reading a signal indicative of one of said identifiers; means responsive to said input of said one identifier for randomly accessing said memory to access said location-specific message unique to said one identifier; and output means for announcing said accessed location-specific message unique to said one identifier, wherein said input means includes a receiver of wireless transmissions.

14. The device of claim 13 further comprising a display connected to said input means to receive and display said one identifier.

15. The device of claim 13 wherein said location-specific messages are commentaries regarding said geographical locations.

16. A portable device for communicating location-specific messages comprising:

memory having a stored library of location-specific messages, each location-specific message having a unique identifier and each having a content related to a particular geographical location of a plurality of geographi-cal locations:

input means for reading a signal indicative of one of said identifiers; means responsive to said input of said one identifier for randomly accessing said memory to access said location-specific message unique to said one identifier; and output means for announcing said accessed location-specific message unique to said one identifier, wherein said input means includes a barcode reader.

* * * * *